US011313370B2

(12) United States Patent
Takano et al.

(10) Patent No.: US 11,313,370 B2
(45) Date of Patent: Apr. 26, 2022

(54) LIQUID-INJECTED SCREW COMPRESSOR

(71) Applicant: Hitachi Industrial Equipment Systems Co., Ltd., Tokyo (JP)

(72) Inventors: Masahiko Takano, Tokyo (JP); Shigeyuki Yorikane, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 16/769,940

(22) PCT Filed: Nov. 14, 2018

(86) PCT No.: PCT/JP2018/042100
§ 371 (c)(1),
(2) Date: Jun. 4, 2020

(87) PCT Pub. No.: WO2019/111661
PCT Pub. Date: Jun. 13, 2019

(65) Prior Publication Data

US 2020/0386231 A1 Dec. 10, 2020

(30) Foreign Application Priority Data

Dec. 8, 2017 (JP) ..... JP2017-235790

(51) Int. Cl.
*F04C 18/16* (2006.01)
*F04C 28/26* (2006.01)
(Continued)

(52) U.S. Cl.
CPC ..... *F04C 28/26* (2013.01); *F04C 18/16* (2013.01); *F04C 18/20* (2013.01); *F04C 29/02* (2013.01)

(58) Field of Classification Search
CPC ..... F04C 28/26; F04C 18/16; F04C 18/20; F04C 29/02; F04C 29/124
See application file for complete search history.

(56) References Cited

U.S. PATENT DOCUMENTS 4,396,345 A 8/1983 Hutchinson
5,207,568 A * 5/1993 Szymaszek ..... F04C 28/125 418/1
(Continued)

FOREIGN PATENT DOCUMENTS

CN 201425024 Y 3/2010
EP 2 423 508 A2 2/2012
(Continued)

OTHER PUBLICATIONS

International Preliminary Report on Patentability (PCT/IB/338 & PCT/IB/373) issued in PCT Application No. PCT/JP2018/042100 dated Jun. 18, 2020, including English translation of document C2 (Japanese-language Written Opinion (PCT/ISA/237) previously filed on Jun. 4, 2020) (six (6) pages).
(Continued)

*Primary Examiner* — Audrey B. Walter
*Assistant Examiner* — Dapinder Singh
(74) *Attorney, Agent, or Firm* — Crowell & Moring LLP

(57) ABSTRACT

A liquid-injected screw compressor includes: a casing that houses a screw rotor and a bearing, and has a suction port and a suction chamber connected to the suction port; a suction throttle valve that is installed at the suction port, and has a housing; and an intake-gas bypass system that establishes communication between a primary side and a secondary side of the suction throttle valve. The intake-gas bypass system includes: an intake-gas bypass flow path that is provided in a wall section of the housing, and has a primary-side opening section opening into the primary side of the suction throttle valve, and a secondary-side opening section opening into the secondary side of the suction throttle valve; and a first check valve arranged in the intake-gas bypass flow path. The intake-gas bypass flow path has an external opening section that opens to an outside
(Continued)

of the housing and that allows insertion and withdrawal of the first check valve. Thereby, it is possible to make the system that communicates with the suction chamber in the casing and is provided with the reverse-flow inhibition mechanism a pipeless structure without impairing advantages of external pipes.

10 Claims, 7 Drawing Sheets

(51) Int. Cl.
*F04C 29/02* (2006.01)
*F04C 18/20* (2006.01)

(56) References Cited

U.S. PATENT DOCUMENTS 8,539,769 B2 * 9/2013 Hansen ..... F02B 33/38 60/611
2004/0151602 A1 8/2004 Daniels et al.
2013/0136638 A1 * 5/2013 Foerster ..... F04C 28/26 418/1
2017/0211575 A1 * 7/2017 Fredrich ..... F04C 29/0092

FOREIGN PATENT DOCUMENTS

JP 2001-173585 A 6/2001
JP 2004-211568 A 7/2004
JP 2004-535528 A 11/2004

OTHER PUBLICATIONS

Hindi-language Office Action issued in Indian Application No. 202017028710 dated Feb. 12, 2021 with partial English translation (six (6) pages).
International Search Report (PCT/ISA/210) issued in PCT Application No. PCT/JP2018/042100 dated Jan. 22, 2019 with English translation (three (3) pages).
Japanese-language Written Opinion (PCT/ISA/237) issued in PCT Application No. PCT/JP2018/042100 dated Jan. 22, 2019 (three (3) pages).
Extended European Search Report issued in European Application No. 18887144.6 dated Jul. 9, 2021 (nine (9) pages).

* cited by examiner

PRIOR ART

LIQUID-INJECTED SCREW COMPRESSOR

TECHNICAL FIELD

The present invention relates to a liquid-injected screw compressor in which a liquid is fed into working chambers for lubrication, cooling, sealing or the like.

BACKGROUND ART

Screw compressors have screw rotor that rotates, and a casing that houses the screw rotor and forms multiple working chambers together with the screw rotor. Such screw compressors are configured to compress a gas (e.g. air) in the working chambers by moving the working chambers in the axial direction of the rotor along with rotation of the screw rotor. A suction throttle valve is provided on the suction side of the casing. The suction throttle is opened and closed for adjustment of intake-gas amount or load of the compressor.

Screw compressors include screw compressors of liquid-injected type in which a liquid such as oil or water is fed into working chambers for the purposes of cooling of a compressed gas, lubrication of screw rotors, sealing of the gap between screw rotors and a casing, and so on. In a liquid-injected screw compressor, a compressed gas on the delivery side (high-pressure side) in a casing instantaneously flows back to the suction side (low-pressure-side) due to a pressure difference when the compressor gets stopped. Along with this reverse flow of the compressed air, a liquid contained in the compressed gas (liquid fed to working chambers) flows back to a suction chamber in the casing, and scatters. At this time, leakage of the liquid to the primary side of a suction throttle valve (the upstream side of the suction throttle valve) is prevented by completely closing the suction throttle valve.

Meanwhile, a plurality of systems including pipes exposed to the outside of the casing (hereinafter, referred to as "external pipes") are connected to the casing. Some systems among those including external pipes communicate with the suction chamber in the casing. In a system having an external pipe communicating with the suction chamber, liquid seeps into the system (into the external pipe) and flows back in some cases if the liquid scatters into the suction chamber at shutdown of the compressor. However, some of those systems may have a problem if liquid seeps and flows back into the systems. In such systems, typically, check valves are installed therein to inhibit a reverse flow of a liquid.

Systems having external pipes communicating with a suction chamber and provided with a check valve include systems that recover a lubricant having leaked through an shaft sealing device provided to screw rotors, for example (see Patent Document 1, for example). A screw rotor of a liquid-injected screw compressor has a structure in which an shaft section on one side thereof extends to the outside of a casing in order for the shaft section to be connected with a rotation driving source such as an electric motor. Bearings that support the screw rotor are arranged in the casing, and an oil is fed for lubrication of the bearings. an shaft sealing device is provided at the shaft section on the one side in order to prevent leakage of a lubricant through the gap between the screw rotor and the casing to the outside. However, the lubricant slightly leaks through the shaft sealing device in some cases. In view of this, in a screw compressor described in Patent Document 1, a recovery pipe which is an external pipe is provided for recovery of a lubricant having leaked through an shaft sealing device. The recovery pipe is connected so as to communicate with two spaces on the primary side and the secondary side of a suction throttle valve, and a reverse-flow inhibition mechanism is provided in the recovery pipe on the secondary side.

As another example of systems having external pipes communicating with a suction chamber and provided with a check valve, for example, there is a system of an external pipe for securing a pressure source for driving a suction throttle valve at start-up of a compressor (hereinafter, referred to as a "system of a breather pipe"). Specifically, as illustrated in FIG. 7, a system BS of a breather pipe P has one side which is connected to a housing H of a suction throttle valve V so as to communicate with a space on the primary side (a suction flow path I) of the suction throttle valve V, and has the other side which is connected to a casing C so as to communicate with a space on the secondary side (a suction chamber R in the casing C) of the suction throttle valve V. The system BS is exposed to the outside of the housing H and the casing C. At start-up of the compressor, the suction throttle valve V is in the closed state. Accordingly, a gas in the suction flow path I on the primary side of the suction throttle valve V is introduced into the suction chamber R in the casing C on the secondary side of the suction throttle valve V via the system BS of the breather pipe P. This intake gas is compressed by the compressor body, and the compressed gas is used as a pressure source for operation of the suction throttle valve V. The system BS of the breather pipe P includes a reverse-flow inhibition mechanism CV for preventing a liquid having scattered into the suction chamber R at shutdown of the compressor from flowing back in the system BS and leaking out to the primary side of the suction throttle valve V.

A lubricant recovery system in the screw compressor described in Patent Document 1 includes a recovery pipe (external pipe) exposed to the outside of the casing, and the reverse-flow inhibition mechanism installed on the recovery pipe. In the case of such a configuration, even if a defect occurs in the reverse-flow inhibition mechanism itself, the reverse-flow inhibition mechanism can be removed from the recovery pipe, and replaced easily. In addition, in the case where a liquid such as a lubricant accumulates near the reverse-flow inhibition mechanism, functions of the reverse-flow inhibition mechanism are impaired in some cases. However, since the recovery pipe is an external pipe, the installation position of the reverse-flow inhibition mechanism on the recovery pipe can be changed easily in order to suppress such occurrences of reverse-flow inhibition failure. Since the system BS of the breather pipe P mentioned before also is a system of an external pipe exposed to the outside of the housing H of the suction throttle valve V similar to the lubricant recovery system, the system BS of the breather pipe P has advantages similar to those of the lubricant recovery system described above. In this manner, systems of external pipes have advantages in terms of ensuring reliability of check valves, and in terms of easy replacement of the check valves.

PRIOR ART DOCUMENT

Patent Document

Patent Document 1: JP-2001-173585-A

SUMMARY OF THE INVENTION

Problem to be Solved by the Invention

However, in the systems of external pipes mentioned above, there is a concern that cracks occur on the external pipes due to vibrations of compressors. In addition, since connection of an external pipe or a reverse-flow inhibition mechanism to a casing or the like necessitates a plurality of joints (F1, F2 and F3 in FIG. 7), there is a problem that the number of parts increases, and the cost increases. In addition, if a large number of external pipes are installed, locations to which dust and dirt can adhere increase also, and this may be disadvantageous in terms of equipment maintenance or the like. Furthermore, spatial occupation of external pipes gives rise of much fear of damages to the pipes due to collision at the time of a movement of a compressor, and there are disadvantages in terms of handling also. Accordingly, it is required to make a system, which communicates with a suction chamber in a casing and which is provided with a check valve, have a pipeless structure without impairing advantages of external pipes.

Means for Solving the Problem

The present application includes a plurality of means for solving the problems described above, and one example of screw compressors includes a screw rotor for compressing a gas; a bearing that rotatably supports the screw rotor; a casing that houses the screw rotor and the bearing and, and has a suction port for suctioning a gas and a suction chamber connected to the suction port; a suction throttle valve that is installed at the suction port, and has a housing forming a suction flow path communicating with the suction port; and an intake-gas bypass system that establishes communication between a primary side and a secondary side of the suction throttle valve. Further, the intake-gas bypass system includes: an intake-gas bypass flow path that is provided in a wall section of the housing, and has a first opening section opening into the primary side of the suction throttle valve and a second opening section opening into the secondary side of the suction throttle valve; and a first check valve that is arranged in the intake-gas bypass flow path, allows a flow from the primary side to the secondary side of the suction throttle valve, and inhibits a flow from the secondary side to the primary side of the suction throttle valve. Furthermore, the intake-gas bypass flow path has a third opening section that opens to an outside of the housing and that allows insertion and withdrawal of the first check valve.

Advantages of the Invention

According to the present invention, the intake-gas bypass flow path that establishes communication between the primary side and the secondary side of the suction throttle valve is provided in the wall section of the housing of the suction throttle valve, the first check valve is arranged in the intake-gas bypass flow path, and the first check valve can be inserted and withdrawn via the third opening section of the intake-gas bypass flow path opening to the outside of the housing. That allows the intake-gas bypass system to have a pipeless structure without impairing advantages of external pipes.

Problems, configurations and effects other than those described above are made clear by the following explanations of embodiments.

MODES FOR CARRYING OUT THE INVENTION

Hereinafter, a liquid-injected screw compressor according to an embodiment of the present invention is explained as an example by using the drawings.

One Embodiment

Figure 1:
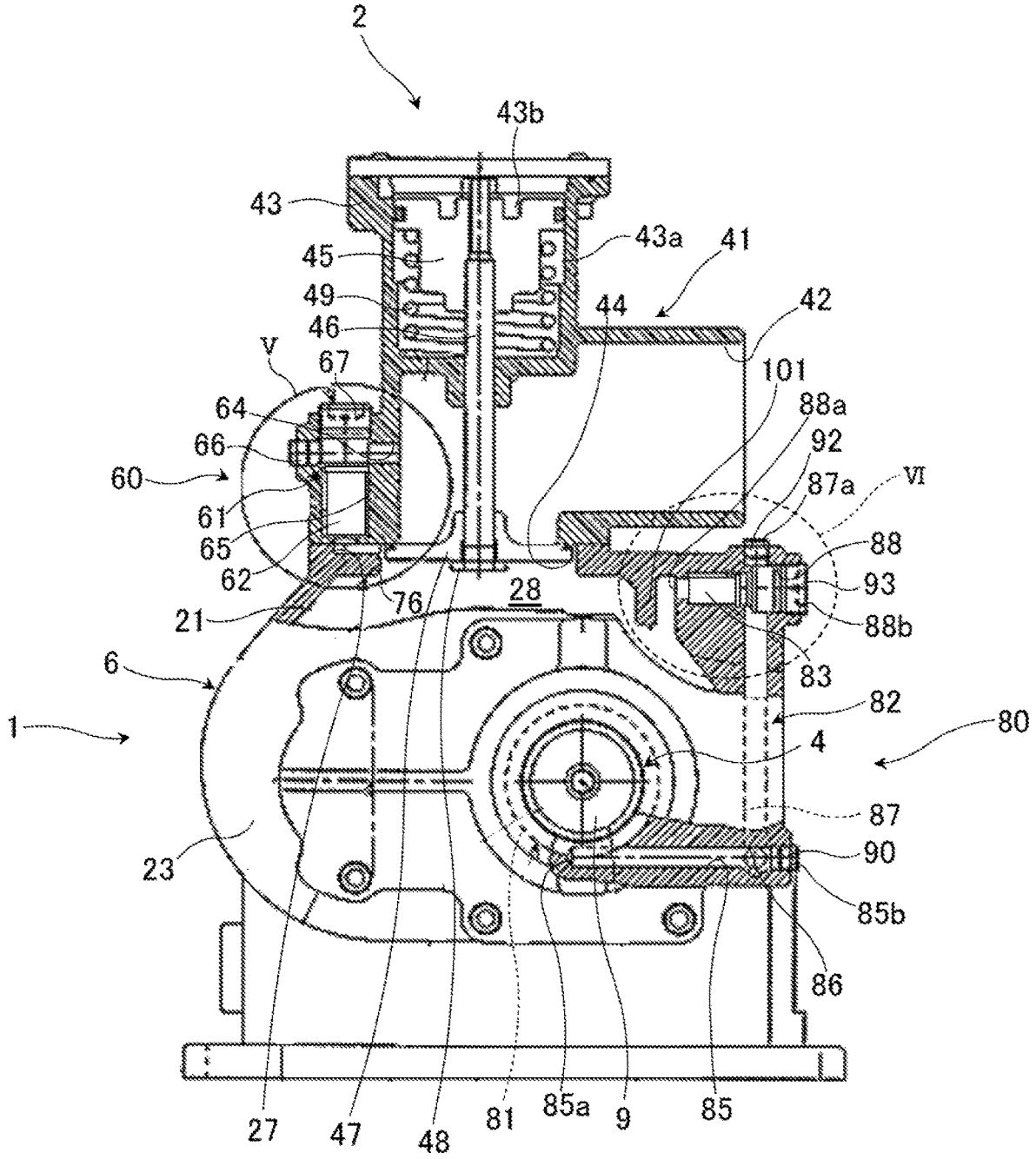
FIG. 1 is a front view illustrating the state of a partial cross section of a liquid-injected screw compressor according to one embodiment of the present invention.
Figure 2:
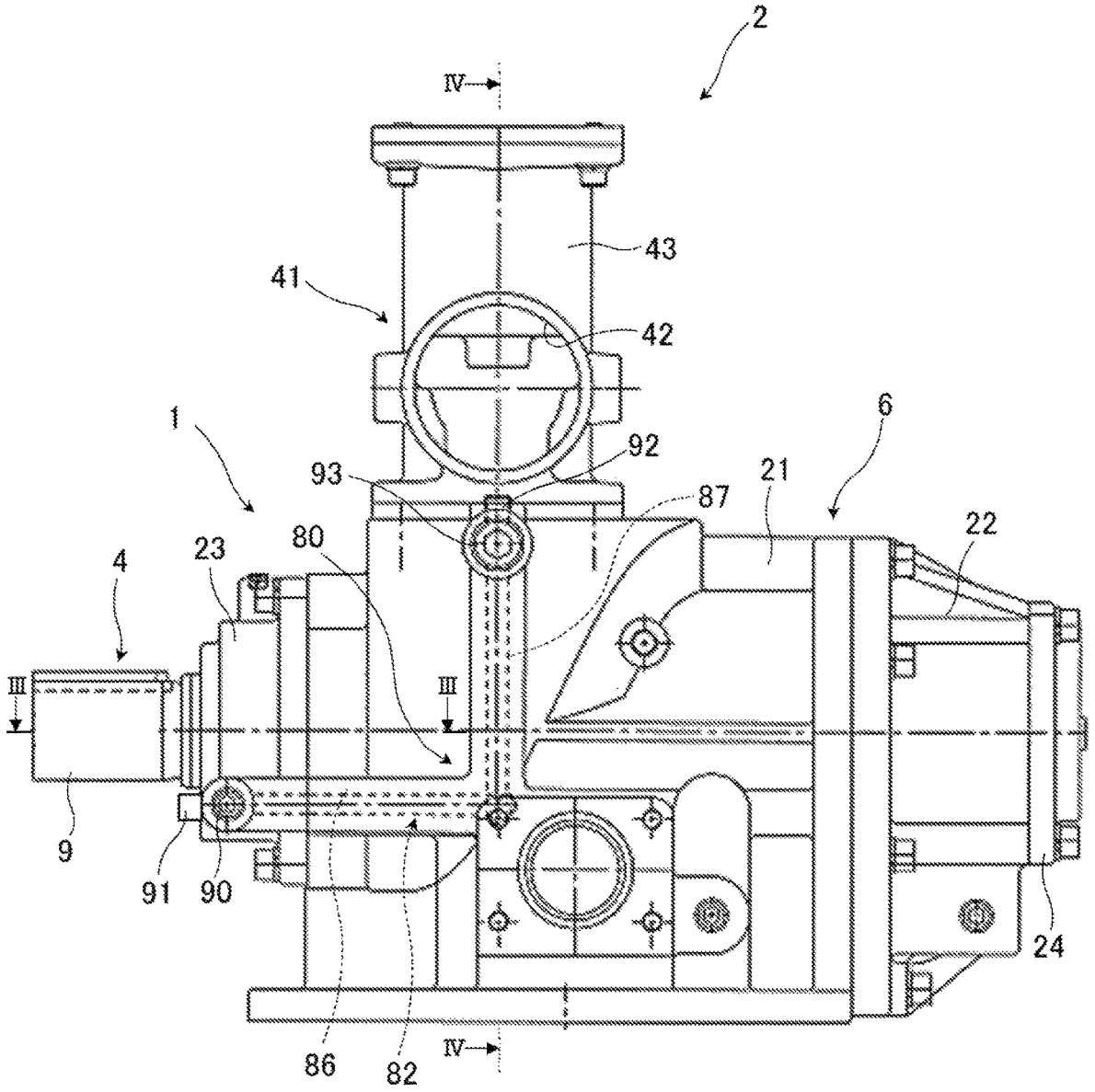
FIG. 2 is a side view of the liquid-injected screw compressor according to the one embodiment illustrated in FIG. 1.
Figure 3:
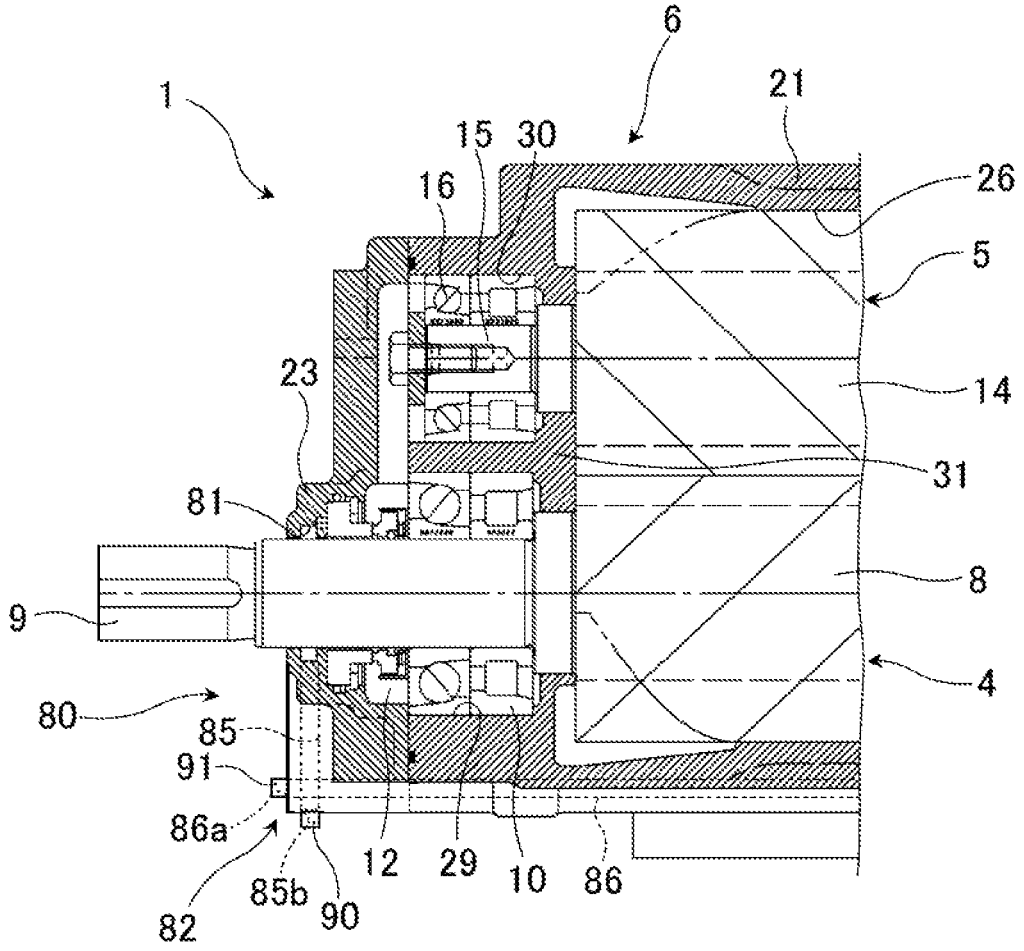
FIG. 3 is a cross-sectional view of part of the liquid-injected screw compressor according to the one embodiment illustrated in FIG. 2 as seen along line III-III.
Figure 4:
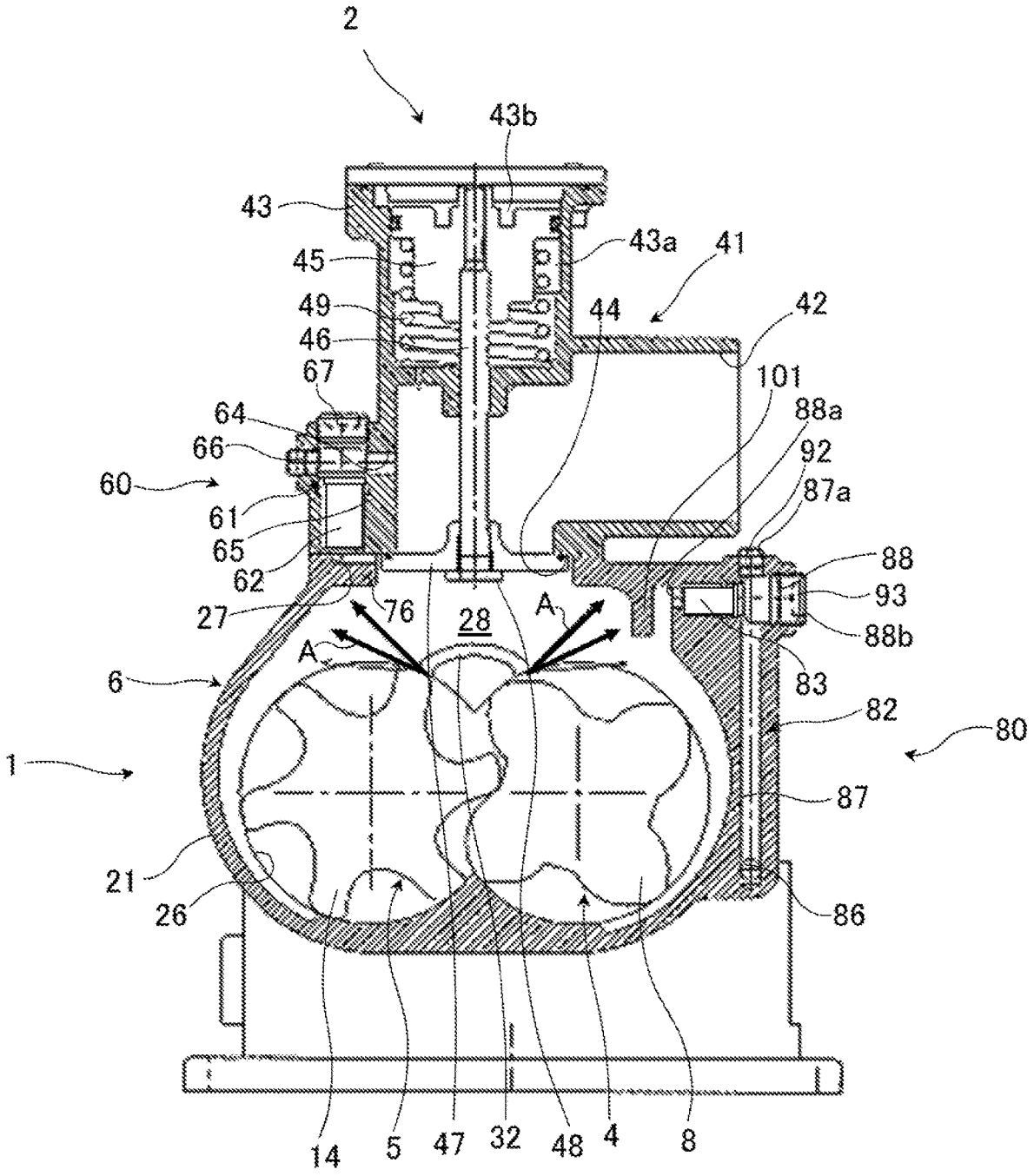
FIG. 4 is a cross-sectional view of the liquid-injected screw compressor according to the one embodiment illustrated in FIG. 2 as seen along line IV-IV.

First, the configuration of the liquid-injected screw compressor according to one embodiment of the present invention is explained by using FIG. 1 to FIG. 4. FIG. 1 is a front view illustrating the state of a partial cross section of the liquid-injected screw compressor according to the one embodiment of the present invention. FIG. 2 is a side view of the liquid-injected screw compressor according to the one embodiment illustrated in FIG. 1. FIG. 3 is a cross-sectional view of part of the liquid-injected screw compressor according to the one embodiment illustrated in FIG. 2 as seen along line III-III. FIG. 4 is a cross-sectional view of the liquid-injected screw compressor according to the one embodiment illustrated in FIG. 2 as seen along line IV-IV.

In FIG. 1 and FIG. 2, the liquid-injected screw compressor includes a compressor body 1 that compresses a gas such as air, and a suction throttle valve 2 installed on the suction side of the compressor body 1 (the upper side in FIG. 1 and FIG. 2).

As illustrated in FIG. 3 and FIG. 4, the compressor body 1 includes a male rotor 4 and a female rotor 5 which are screw rotors having a plurality of helical tooth sections, and a casing 6 that houses the male rotor 4 and the female rotor 5. The male rotor 4 and the female rotor 5 have parallel rotation axes, and rotate while meshing with each other. A plurality of working chambers are formed between the male rotor 4 and female rotor 5, and the casing 6. Along with rotation of the male rotor 4 and the female rotor 5, the working chambers move in the axial direction of the rotors, and thereby a gas in the working chambers is compressed. A liquid such as an oil or water is fed into the working chambers for the purpose of cooling of the compressed gas in the working chambers, lubrication of the male and female rotors 4 and 5, and sealing of the gaps between the tooth edges of both the male and female rotors 4 and 5, and the inner wall of a main casing 21 or the gap between meshing sections of the male and female rotors 4 and 5.

As illustrated in FIG. 3, the male rotor 4 includes a rotor tooth section 8 having a plurality of male teeth, and shaft sections 9 (only one on the suction side is illustrated in FIG. 3) integrally provided on both sides of the rotor tooth section 8 in the axial direction. The shaft section 9 on a suction-side of the male rotor 4 extends out of the casing 6 so as to be coupled with a rotation shaft of a rotation driving source such as an electric motor. The male rotor 4 is rotatably supported by a suction-side bearing 10 and a delivery-side bearing (not illustrated). The suction-side bearing 10 and the delivery-side bearing are housed in the casing 6. The suction-side bearing 10 and the delivery-side bearing are fed with a lubricant. The suction-side shaft section 9 is provided with an shaft sealing device 12 that seals the gap between the suction-side shaft section 9 and the casing 6. The shaft sealing device 12 prevents leakage of the lubricant fed to the suction-side bearing 10 to the outside of the casing 6. As the shaft sealing device 12, a mechanical seal is used, for example.

The female rotor 5 includes a rotor tooth section 14 having a plurality of female teeth, and shaft sections 15 (only one on the suction side is illustrated in FIG. 3) integrally provided on both sides of the rotor tooth section 14 in the axial direction. The female rotor 5 is rotatably supported by a suction-side bearing 16 and a delivery-side bearing (not illustrated), and is configured to rotate while meshing with the male rotor 4 along with rotation of the male rotor 4. The suction-side bearing 16 and the delivery-side bearing (not illustrated) are housed in the casing 6. The suction-side bearing 16 and the delivery-side bearing are fed with a lubricant.

As illustrated in FIG. 2, the casing 6 includes the main casing 21, and a delivery-side casing 22 that covers the delivery side (the right side in FIG. 2) of the main casing 21.

As illustrated in FIG. 4, two partially overlapping cylindrical bores 26 are formed in the main casing 21, and the male rotor 4 and the female rotor 5 are housed in the bores 26. As illustrated in FIG. 1 and FIG. 4, a suction port 27 that suctions a gas is provided on an outer circumference section of the main casing 21, and the suction throttle valve 2 is installed at the suction port 27. A suction chamber 28 connected to the suction port 27 is formed inside the main casing 21. The suction chamber 28 communicates with the bores 26, and is a space for a gas suctioned through the suction port 27 to be distributed to working chambers in an intake process. As illustrated in FIG. 3, an end section of the main casing 21 on the suction side in the axial direction is provided with suction-side bearing chambers 29 and 30 that hold the suction-side bearings 10 and 16, respectively. The suction-side bearing chambers 29 and 30, and the bores 26 are partitioned by a partition wall 31. A suction-side cover 23 that covers the suction-side bearing chambers 29 and 30 is attached to the main casing 21. The suction-side cover 23 contains the shaft sealing device 12. The main casing 21 is provided with a liquid-feed path (not illustrated) for feeding a liquid to the working chambers.

As illustrated in FIG. 4, the suction chamber 28 in the casing 6 is provided with a scattering cover 32 so as to cover the meshing sections of the male rotor 4 and the female rotor 5. In the liquid-injected screw compressor, during its operation, a liquid contained in the compressed gas in the working chambers spouts out through the gap between the meshing sections of the male rotor 4 and the female rotor 5 due to the pressure difference between a high-pressure-side working chamber and a low-pressure-side working chamber (in FIG. 4, the liquid which is spouting out is illustrated by arrows A). The scattering cover 32 suppresses the spreading, toward the suction throttle valve 2, of the liquid spouting out from the gap between the meshing sections, and suppresses heating of an intake gas due to the liquid having spouted out. In addition, the scattering cover 32 also has a function of distributing the intake gas having flowed in through the suction port 27 of the casing 6 to working chambers in a suction process on the side where the male rotor 4 is located and working chambers in a suction process on the side where the female rotor 5 is located. For example, the scattering cover 32 is formed in a concave shape (an approximately U-shape in the cross section) toward the meshing sections, and has a predetermined restricted size such that the scattering cover 32 does not become a resistance to the intake gas.

The delivery-side casing 22 illustrated in FIG. 2 is provided with a delivery path (not illustrated) that guides the gas compressed in the working chambers to the outside, and delivery-side bearing chambers (not illustrated) that hold the delivery-side bearings (not illustrated) of the male rotor 4 and the female rotor 5. A delivery-side cover 24 that covers the delivery-side bearing chambers is attached to the delivery-side casing 22.

In the present embodiment, the main casing 21, the delivery-side casing 22, the suction-side cover 23 and the delivery-side cover 24 constitute at least part of the casing 6.

For example, the suction throttle valve 2 regulates the suction amount of the compressor body 1 in accordance with customer's compressed gas usage. In addition, the suction throttle valve 2 blocks suction by the compressor body 1 in order to perform no-load operation control (unloading operation control) of lowering the pressure on the delivery side while the operation of the compressor body 1 is continued. In addition, the suction throttle valve 2 prevents leakage, toward the upstream side, of the compressed gas that flows back from the delivery side to the suction side of the compressor body 1 at shutdown of the compressor body 1, and leakage of a liquid contained in the gas. As illustrated in FIG. 1 and FIG. 4, the suction throttle valve 2 includes: a housing 41 that forms a suction flow path 42 and a cylinder 43; a valve seat 44 formed at a downstream end section of the suction flow path 42; a piston 45 that is slidably arranged in the cylinder 43, and divides the inside of the cylinder 43 into a spring chamber 43*a* and an operation chamber 43*b*; a rod 46 which has one end connected to the piston 45 and which penetrates the cylinder 43 to extend toward the downstream side (the lower side in FIG. 1 and FIG. 4) of the suction flow path 42; a valve body 47 to which the rod 46 is slidably inserted and which is positioned on the downstream side of the valve seat 44 and can open and close the valve seat 44; a stopper section 48 that is provided at a tip section of the rod 46, and regulates a sliding motion of the valve body 47 toward the downstream side; and a spring 49 arranged in the spring chamber 43*a* in the cylinder 43. For example, the suction flow path 42 is a flow path bent at an approximately right angle. For example, the spring 49 applies, to the piston 45, an urging force to move the stopper section 48 toward the upstream side (the upper side in FIG. 1 and FIG. 4).

An operation pressure system (not illustrated) is connected to the operation chamber 43*b* in the cylinder 43. The operation pressure system introduces part of the compressed air extracted from delivery side of a compressed air system in the compressor body 1 into the operation chamber 43*b* in the cylinder 43 to thereby apply, to the piston 45, a pressure to move the stopper section 48 toward the downstream side (the lower side in FIG. 1 and FIG. 4) against the urging force of the spring 49 in the spring chamber 43*a*. For example, the operation pressure system includes a solenoid valve (not illustrated) that is opened and closed by a drive signal from a controller (not illustrated), and regulates an input of the compressed air into the operation chamber 43*b* in the cylinder 43 by opening and closing of the solenoid valve.

Meanwhile, at start-up of the compressor, the delivery side of the compressed air system in the compressor body 1, which is a pressure source for operating the suction throttle valve 2, has a reduced pressure. In view of this, in the present embodiment, in order to obtain an operation pressure of the suction throttle valve 2 at start-up of the compressor, an intake-gas bypass system 60 that allows an intake gas to bypass the suction throttle valve 2 in the closed state and to be introduced into the compressor body 1 is provided. Details of the intake-gas bypass system 60 are mentioned below.

In addition, a lubricant fed to the suction-side bearings 10 and 16 slightly leaks through the shaft sealing device 12 provided to the shaft section 9 on the suction-side of the male rotor 4 illustrated in FIG. 3 in some cases. In view of this, in the present embodiment, as illustrated in FIG. 1 and FIG. 4, an oil-recovery system 80 that recovers, to the secondary side (the suction chamber 28 of the casing 6) of the suction throttle valve 2, the lubricant having leaked through the shaft sealing device 12 is provided. Details of the oil-recovery system 80 are mentioned below.

Figure 5:
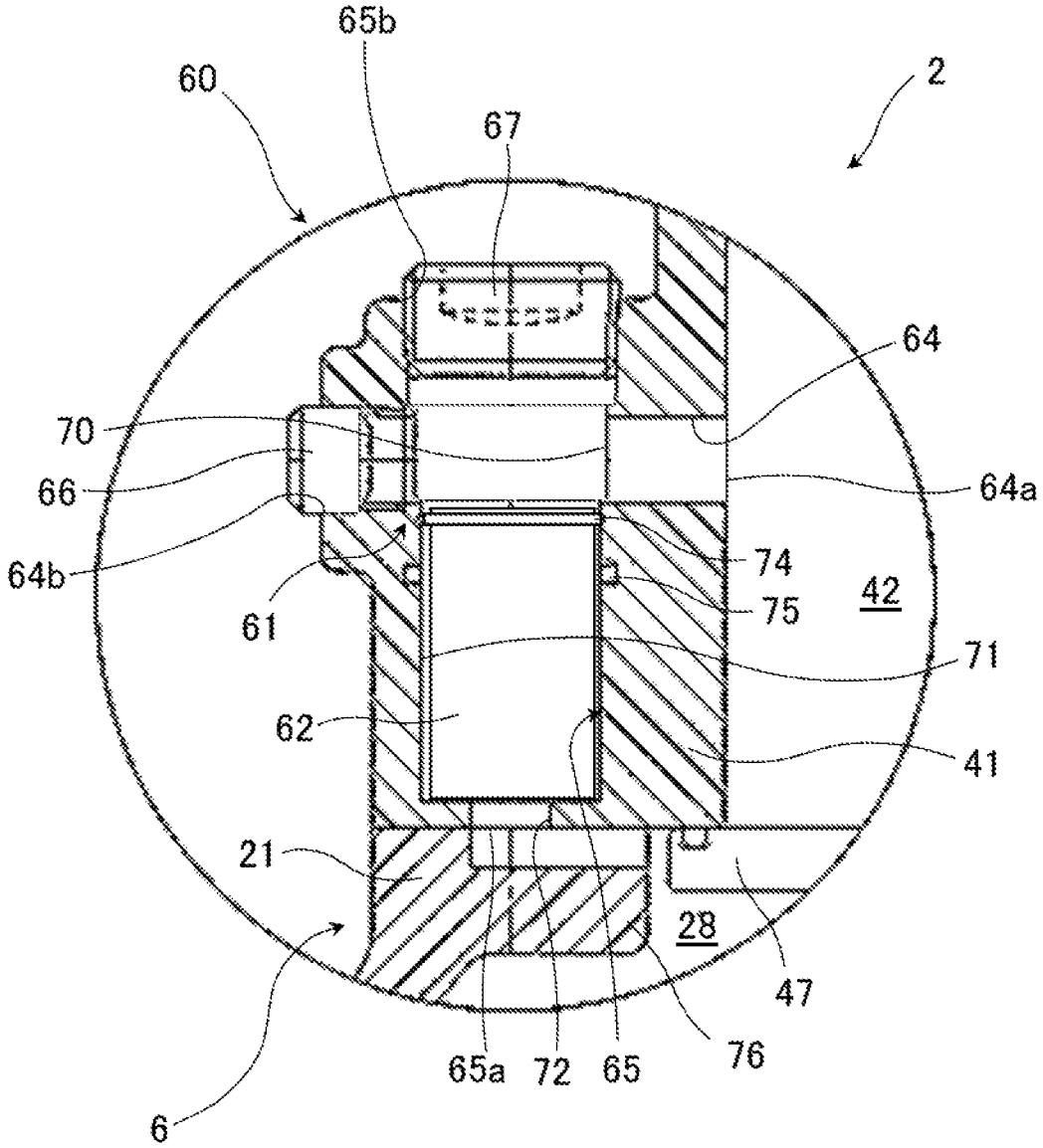
FIG. 5 is an enlarged cross-sectional view of an intake-gas bypass system of the liquid-injected screw compressor according to the one embodiment, indicated by reference character V in FIG. 1.

Next, details of the intake-gas bypass system of the liquid-injected screw compressor according to the one embodiment of the present invention are explained by using FIG. 4 and FIG. 5. FIG. 5 is an enlarged cross-sectional view of the intake-gas bypass system of the liquid-injected screw compressor according to the one embodiment indicated by reference character V in FIG. 1. In FIG. 5, those having the same reference characters as reference characters illustrated in FIG. 1 to FIG. 4 are identical parts to those in FIG. 1 to FIG. 4, detailed explanations thereof are omitted.

As illustrated in FIG. 4 and FIG. 5, the intake-gas bypass system 60 establishes communication between the suction flow path 42 of the suction throttle valve 2 (the primary side of the suction throttle valve 2) and the suction chamber 28 (the secondary side of the suction throttle valve 2) in the casing 6. The intake-gas bypass system 60 has an intake-gas bypass flow path 61 provided in a wall section of the housing 41 and a first check valve 62 arranged in the intake-gas bypass flow path 61.

For example, the intake-gas bypass flow path 61 includes a first bypass-flow-path hole 64 and a second bypass-flow-path hole 65. The first bypass-flow-path hole 64 has a primary-side opening section 64*a* opening into the suction flow path 42 of the suction throttle valve 2 and a first external opening section 64*b* opening to the outside of the housing 41, and is provided in the wall section of the housing 41 so as to extend linearly in the horizontal direction. The second bypass-flow-path hole 65 has a secondary-side opening section 65*a* opening into the suction chamber 28 in the casing 6 and a second external opening section 65*b* opening to the outside of the housing 41, and is provided in the wall section of the housing 41 so as to extend linearly in the upward/downward direction and communicate with the first bypass-flow-path hole 64. A first plug 66 is removably attached to the first external opening section 64*b* of the first bypass-flow-path hole 64. A second plug 67 is removably attached to the second external opening section 65*b*.

The second bypass-flow-path hole 65 includes a large diameter section 70 having the second external opening section 65*b*, an intermediate diameter section 71 adjacent to the large diameter section 70, and a small diameter section 72 adjacent to the intermediate diameter section 71 and having the secondary-side opening section 65*a*. The large diameter section 70 has a diameter larger than the diameter of the first check valve 62. The intermediate diameter section 71 has a diameter smaller than the diameter of the large diameter section 70, and slightly larger than the diameter of the first check valve 62. The small diameter section 72 has a diameter smaller than the diameter of the first check valve 62. That is, the second bypass-flow-path hole 65 is a stepped hole having two steps. The intermediate diameter section 71 is a portion where the first check valve 62 is arranged. The small diameter section 72 restricts a movement of the first check valve 62 toward the suction chamber 28. The second external opening section 65*b* of the large diameter section 70 allows insertion of the first check valve 62 into the intermediate diameter section 71, and withdrawal of the first check valve 62 from the intermediate diameter section 71. The large diameter section 70 is formed to have a hole diameter that allows easy insertion and withdrawal of the first check valve 62.

The first bypass-flow-path hole 64 can be formed by boring a lateral hole penetrating the wall section of the housing 41 from the lateral outer surface of the housing 41 to the suction flow path 42. The second bypass-flow-path hole 65 can be formed by: boring a first vertical hole penetrating from the upper outer surface of the housing 41 to the suction chamber 28; boring a second vertical hole having a hole diameter larger than the hole diameter of the first vertical hole such that the second vertical hole becomes coaxial with the first vertical hole and does not penetrate to the suction chamber 28; and boring a third vertical hole having a hole diameter larger than the hole diameter of the second vertical hole such that the third vertical hole becomes coaxial with the first vertical hole and shorter than the second vertical hole.

While the first check valve 62 allows a flow from the side where the suction flow path 42 is located to the side where the suction chamber 28 is located, the first check valve 62 inhibits a flow from the side where the suction chamber 28 is located to the side where the suction flow path 42 is located. That is, the first check valve 62 prevents a liquid having flowed back from the delivery side of the compressor body 1 to the suction chamber 28 at the time of a driving stop of the compressor, from leaking toward the primary side of the suction throttle valve 2 via the intake-gas bypass flow path 61. A retaining ring 74 and an O-ring 75 are attached to an outer circumference section of the first check valve 62. The retaining ring 74 restricts a movement of the first check valve 62 in the intermediate diameter section 71. The O-ring 75 inhibits a leakage flow from the gap between the outer circumferential surface of the first check valve 62 and the inner-wall surface of the intake-gas bypass flow path 61. The first check valve 62 can be replaced by accessing the first check valve 62 via the second external opening section 65*b* of the large diameter section 70 of the second bypass-flow-path hole 65. For replacement of the first check valve 62, the second plug 67 shutting off the second external opening section 65*b* is removed, and a tool is used, for example.

In the intake-gas bypass system 60 with the configuration described above, the intake-gas bypass flow path 61 can be formed by boring the linear first bypass-flow-path hole 64 and second bypass-flow-path hole 65 in the wall section of the housing 41 of the suction throttle valve 2. Therefore, fabrication of the intake-gas bypass flow path 61 is easy. In addition, compared with a case where an intake-gas bypass system (external pipe) is configured by connecting a pipe provided with a check valve with the housing 41 of the suction throttle valve 2, the intake-gas bypass system 60 does not require the pipe, a joint for connecting the pipe to the housing 41, and a joint for attaching the check valve to the pipe.

Meanwhile, there is a fear that, if a liquid such as an oil accumulates in the first check valve 62, the responsiveness of the valve body of the first check valve 62 deteriorates due to the influence of the liquid, and failures of reverse-flow inhibition occur. As mentioned before, in the liquid-injected screw compressor, during its operation, the liquid contained in the compressed gas in the working chambers spouts out to the suction chamber 28 in the casing 6 through the gap between the meshing sections of the male rotor 4 and the female rotor 5 due to the pressure difference between working chambers on the high-pressure-side and working chambers on the low-pressure-side. Since the present embodiment adopts a configuration in which the housing 41 has the built-in intake-gas bypass system 60, the liquid having spouted out to the suction chamber 28 might seep into the intake-gas bypass flow path 61, and accumulate near the first check valve 62. In this case, there is a concern that, due to a failure of reverse-flow inhibition of the first check valve 62, a reverse flow of the liquid from the suction chamber 28 to the primary side of the suction throttle valve 2 via the intake-gas bypass flow path 61 at shutdown of the compressor cannot be prevented.

In view of this, in the present embodiment, a first blocking section 76 is provided between the secondary-side opening section 65*a* of the intake-gas bypass flow path 61, and the meshing sections of the male and female rotors 4 and 5 in the suction chamber 28 of the casing 6. The first blocking section 76 prevents seepages, to the intake-gas bypass flow path 61, of the liquid spouting out from the meshing sections at the time of an operation of the compressor. As a specific structure, for example, the first blocking section 76 is arranged on a line that extends from the meshing sections of the male rotor 4 and the female rotor 5 toward the secondary-side opening section 65*a* of the intake-gas bypass flow path 61, and protrudes from a wall section of the main casing 21 toward the suction chamber 28 so as to cover the secondary-side opening section 65*a* in a separated state.

Figure 6:
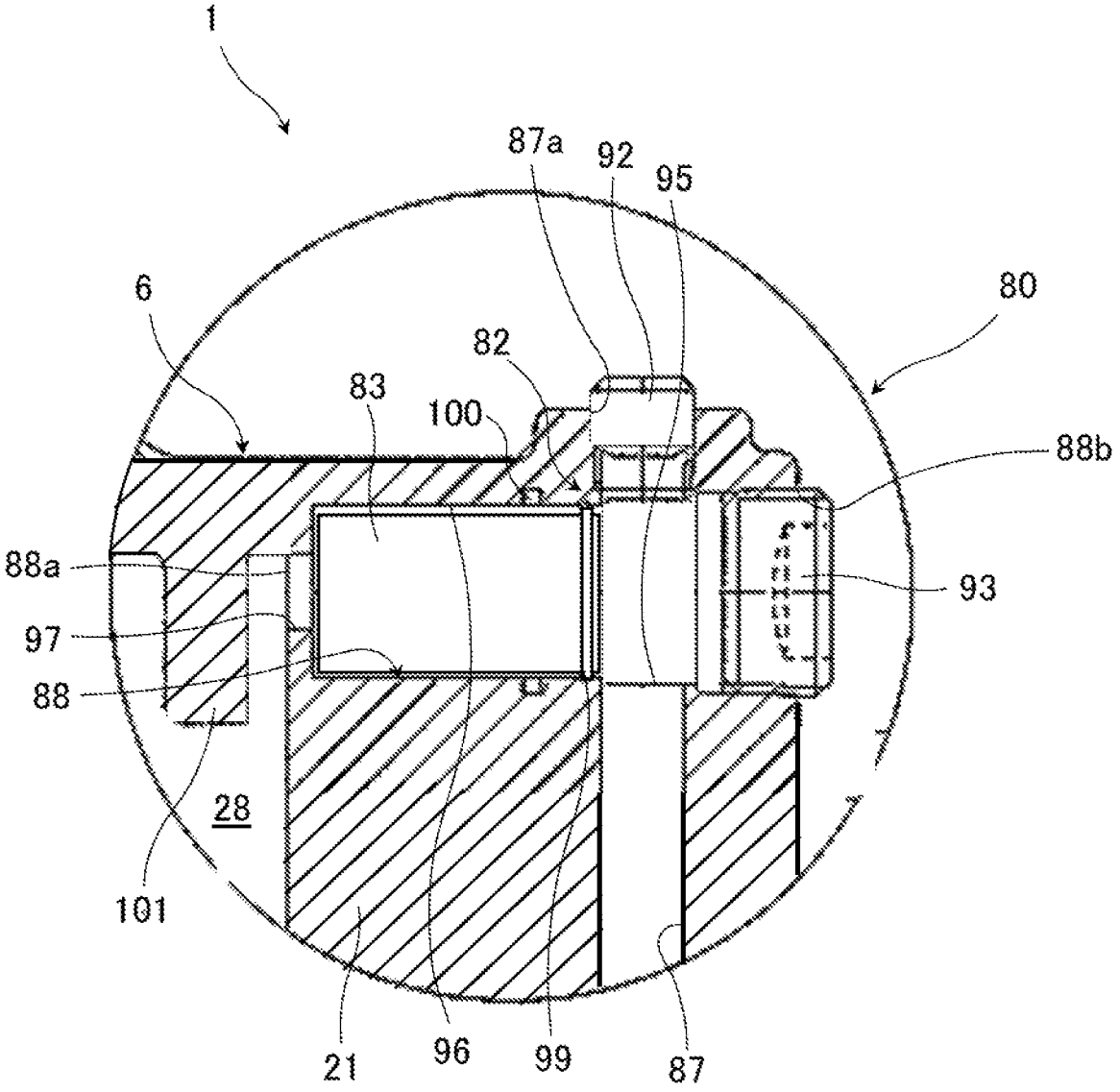
FIG. 6 is an enlarged cross-sectional view of part of an oil-recovery system of the liquid-injected screw compressor according to the one embodiment, indicated by reference character VI in FIG. 1.
Figure 7:
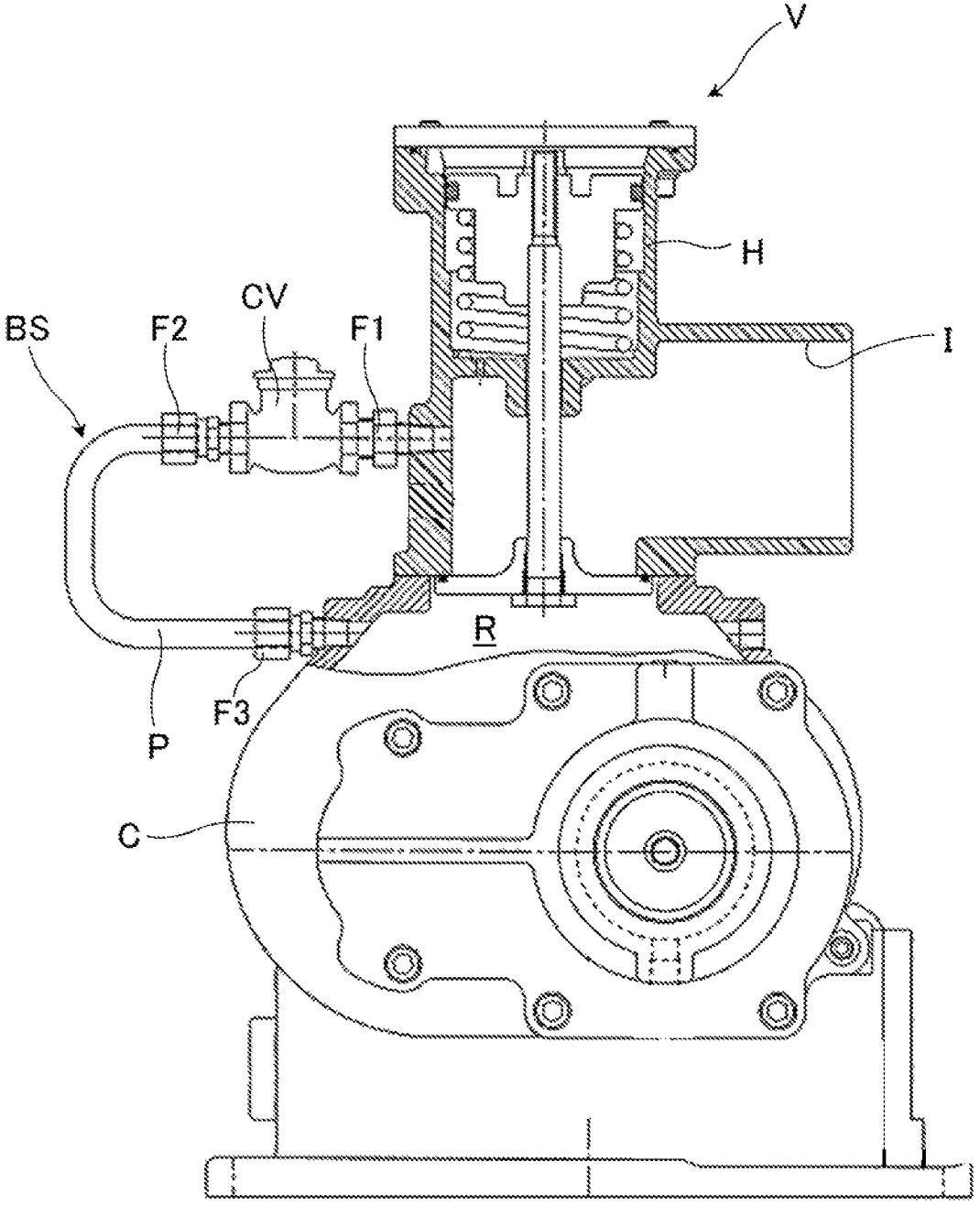
FIG. 7 is a front view illustrating the state of a partial cross section of a conventional liquid-injected screw compressor.

Next, details of the oil-recovery system of the liquid-injected screw compressor according to the one embodiment of the present invention are explained by using FIG. 1 to FIG. 4 and FIG. 6. FIG. 6 is an enlarged cross-sectional view of part of the oil-recovery system of the liquid-injected screw compressor according to the one embodiment indicated by reference character VI in FIG. 1. In FIG. 6, those having the same reference characters as reference characters illustrated in FIG. 1 to FIG. 5 are identical parts to those in FIG. 1 to FIG. 5, detailed explanations thereof are omitted.

As illustrated in FIG. 1 and FIG. 3, the oil-recovery system 80 includes a recovery groove section 81 as an oil storage section that can temporarily store a lubricant having leaked through the shaft sealing device 12, an oil-recovery flow path 82 that establishes communication between the recovery groove section 81 and the suction chamber 28 in the casing 6, and a second check valve 83 arranged in the oil-recovery flow path 82. The recovery groove section 81 is provided on the inner-side surface of the suction-side cover 23 so as to lie along the side of the outer circumferential surface of the shaft section 9 on the suction-side of the male rotor 4.

As illustrated in FIG. 1 to FIG. 4, the oil-recovery flow path 82 is provided in wall sections of the suction-side cover 23 and the main casing 21 constituting part of the casing 6. The oil-recovery flow path 82 has a storage-side opening section 85*a* opening into the recovery groove section 81, and a recovery-side opening section 88*a* opening into the suction chamber 28. For example, the oil-recovery flow path 82 includes a first recovery-flow-path hole 85 communicating with the recovery groove section 81, a second recovery-flow-path hole 86 communicating with the first recovery-flow-path hole 85, a third recovery-flow-path hole 87 communicating with the second recovery-flow-path hole 86, and a fourth recovery-flow-path hole 88 communicating with the third recovery-flow-path hole 87 and the suction chamber 28 in the casing 6.

The first recovery-flow-path hole 85 is provided in a wall section of the suction-side cover 23. The first recovery-flow-path hole 85 has the storage-side opening section 85*a* on the side where the recovery groove section 81 is located, and a third external opening section 85*b* opening to the outside of the suction-side cover 23, and extends linearly in a direction of the tangent of the annular recovery groove section 81 from a lowermost end section of the recovery groove section 81. A third plug 90 is removably attached to the third external opening section 85*b* of the first recovery-flow-path hole 85.

The second recovery-flow-path hole 86 is provided in the wall sections of the suction-side cover 23 and the main casing 21. The second recovery-flow-path hole 86 has a fourth external opening section 86*a* opening to the outside of the suction-side cover 23, and extends linearly in a direction toward the delivery side along the axial direction of the male rotor 4 so as to cross the first recovery-flow-path hole 85. A fourth plug 91 is removably attached to the fourth external opening section 86*a* of the second recovery-flow-path hole 86.

The third recovery-flow-path hole 87 is provided in the wall section of the main casing 21. The third recovery-flow-path hole 87 has a fifth external opening section 87*a* opening to the outside of the main casing 21, and extends linearly toward the suction throttle valve 2 (the upper side in FIG. 2 and FIG. 4) from an end section of the second recovery-flow-path hole 86. A fifth plug 92 is removably attached to the fifth external opening section 87*a* of the third recovery-flow-path hole 87.

As illustrated in FIG. 4 and FIG. 6, the fourth recovery-flow-path hole 88 is provided in the wall section of the main casing 21. The fourth recovery-flow-path hole 88 has the recovery-side opening section 88*a* on the side where the suction chamber 28 is located, and a sixth external opening section 88*b* opening to the outside of the main casing 21, and extends linearly in the horizontal direction so as to cross the third recovery-flow-path hole 87 at a position higher than the male rotor 4. A sixth plug 93 is removably attached to the sixth external opening section 88*b* of the fourth recovery-flow-path hole 88.

The fourth recovery-flow-path hole 88 includes: a large diameter section 95 positioned on the outer side, and having the sixth external opening section 88*b*; an intermediate diameter section 96 adjacent to the large diameter section 95, and a small diameter section 97 adjacent to the intermediate diameter section 96, and having the recovery-side opening section 88*a* on the side where the suction chamber 28 is located. The large diameter section 95 has a diameter larger than the diameter of the second check valve 83. The intermediate diameter section 96 has a diameter smaller than the diameter of the large diameter section 95, and slightly larger than the diameter of the second check valve 83. The small diameter section 97 has a diameter smaller than the diameter of the second check valve 83. That is, the fourth recovery-flow-path hole 88 is a stepped hole having two steps. The intermediate diameter section 96 is a portion where the second check valve 83 is arranged. The small diameter section 97 restricts a movement of the second check valve 83 toward the suction chamber 28. The sixth external opening section 88*b* of the large diameter section 95 allows insertion of the second check valve 83 into the intermediate diameter section 96, and withdrawal of the second check valve 83 from the intermediate diameter section 96. The large diameter section 95 is formed to have a diameter that allows easy insertion and withdrawal of the second check valve 83.

The first recovery-flow-path hole 85 can be formed by boring a lateral hole penetrating the wall section of the suction-side cover 23 from the lateral outer surface of the suction-side cover 23 to the lowermost end section of the recovery groove section 81. The second recovery-flow-path hole 86 can be formed by boring a lateral hole with a predetermined length from the outer surface of the suction-side cover 23 to the main casing 21 along the axial direction of the male rotor 4. The third recovery-flow-path hole 87 can be formed by boring a longitudinal hole downward from the upper outer surface of the main casing 21 so as to reach an end section of the second recovery-flow-path hole 86. The fourth recovery-flow-path hole 88 can be formed by: boring a first lateral hole penetrating from the lateral outer surface of the main casing 21 on the side where the male rotor 4 is located, to the suction chamber 28 in the casing 6; boring a second lateral hole having a hole diameter larger than the hole diameter of the first lateral hole such that the second lateral hole becomes coaxial with the first lateral hole, and does not penetrate to the suction chamber 28; and boring a third lateral hole having a hole diameter larger than the hole diameter of the second lateral hole such that the third lateral hole becomes coaxial with the first lateral hole, and shorter than the second lateral hole.

While the second check valve 83 allows a flow from the side where the recovery groove section 81 is located to the side where the suction chamber 28 is located, the second check valve 83 inhibits a flow from the side where the suction chamber 28 is located to the side where the recovery groove section 81 is located. That is, the second check valve 83 prevents a liquid having flowed back from the delivery side of the compressor body 1 to the suction chamber 28 at the time of a driving stop of the compressor, from leaking to the outside of the casing 6 (suction-side cover 23) via the oil-recovery flow path 82 and the recovery groove section 81. A retaining ring 99 and an O-ring 100 are attached to the outer circumferential surface of the second check valve 83. The retaining ring 99 restricts a movement of the second check valve 83 in the intermediate diameter section 96. The O-ring 100 inhibits a leakage flow from the gap between the outer circumferential surface of the second check valve 83 and the inner-wall surface of the oil-recovery flow path 82. The second check valve 83 can be replaced by accessing the second check valve 83 via the sixth external opening section 88*b* of the large diameter section 95 of the fourth recovery-flow-path hole 88. For replacement of the second check valve 83, the sixth plug 93 shutting off the sixth external opening section 88*b* is removed, and a tool is used, for example.

In the oil-recovery system 80 with the configuration described above, the oil-recovery flow path 82 can be formed by boring the four linear recovery-flow-path holes, the first recovery-flow-path hole 85, the second recovery-flow-path hole 86, the third recovery-flow-path hole 87 and the fourth recovery-flow-path hole 88 through the wall section of the casing 6. Therefore, fabrication of the oil-recovery flow path 82 is easy. In addition, compared with a case where an oil-recovery system (external pipe) is configured by connecting a pipe provided with a check valve with the casing 6, the oil-recovery system 80 does not require the pipe, a joint for connecting the pipe to the casing 6, and a joint for attaching the check valve to the pipe.

Since the present embodiment adopts a configuration in which the casing 6 has the built-in oil-recovery system 80, the liquid having spouted out to the suction chamber 28 might seep into the oil-recovery flow path 82, and accumulate near the second check valve 83, similar to the first check valve 62 mentioned before. In this case, there is a concern that, due to a reverse-flow inhibition failure of the second check valve 83, a reverse flow of the liquid from the suction chamber 28 to the outside of the casing 6 via the oil-recovery flow path 82 at shutdown of the compressor cannot be prevented.

In view of this, in the present embodiment, a second blocking section 101 is provided between the recovery-side opening section 88*a* of the oil-recovery flow path 82, and the meshing sections of the male and female rotors 4 and 5 in the suction chamber 28 of the casing 6. The second blocking section 101 prevents seepages, into the oil-recovery flow path 82, of the liquid (illustrated with the arrows A in FIG. 4) spouting out from the meshing sections at the time of an operation of the compressor. As a specific structure, for example, the second blocking section 101 is arranged on a line that extends from the meshing sections of the male rotor 4 and the female rotor 5 toward the recovery-side opening section 88*a* of the oil-recovery flow path 82, and protrudes from a wall section of the main casing 21 toward the suction chamber 28 so as to cover the recovery-side opening section 88*a* in a separated state.

Next, the actions of the liquid-injected screw compressor according to the one embodiment of the present invention at the time of a start-up, a loading operation, an unloading operation, and a shutdown is explained by using FIG. 1 to FIG. 6.

First, the action at the time of start-up of the compressor is explained. Since, at the start-up, the pressure of the pressure source for operating the suction throttle valve 2 is lowered, the suction throttle valve 2 illustrated in FIG. 4 is in the closed state due to the urging force of the spring 49. If, in this state, the male rotor 4 and the female rotor 5 of the compressor body 1 are started up, a small amount of a gas flows into the suction chamber 28 in the casing 6, which is the secondary side of the suction throttle valve 2, from the suction flow path 42, which is the primary side of the suction throttle valve 2, via the intake-gas bypass flow path 61 provided in the wall section of the housing 41 of the suction throttle valve 2 and via the first check valve 62 arranged in the intake-gas bypass flow path 61. This gas is compressed in the compressor body 1, and delivered to the outside of the compressor body 1. Part of the delivered compressed gas is extracted, and used as the pressure source for operation of the suction throttle valve 2.

In this manner, an intake gas bypasses the valve body 47 of the suction throttle valve 2 in the closed state and is introduced into the suction chamber 28 in the casing 6 via the intake-gas bypass flow path 61 provided in the wall section of the housing 41 at the start-up of the compressor. Accordingly, the pressure source to operate the suction throttle valve 2 can be secured at the start-up of the compressor.

Second, the action during a loading operation of the compressor is explained. At the time of the loading operation, part of air compressed in the working chambers on the high-pressure-side leaks into the suction chamber 28 through the gap between the meshing sections of the male rotor 4 and the female rotor 5 due to the pressure difference from the working chambers on the low-pressure-side. As illustrated in FIG. 4, along with this leakage of the compressed air, part of a high-temperature liquid contained in the compressed gas spouts out from the meshing sections radially into the suction chamber 28. Of the liquid having spouted out from the meshing sections, a liquid having spouted out toward the suction throttle valve 2 (the upper side in FIG. 4) is blocked by the scattering cover 32. This can suppress heating of an intake gas having flowed into the suction chamber 28 from the suction throttle valve 2 due to the high-temperature liquid having spouted out. Accordingly, lowering of the density due to a temperature rise of the intake gas can be suppressed, and deterioration of the performance of the compressor can be suppressed.

On the other hand, part of the liquid having spouted out from the meshing section (illustrated with the arrows A in FIG. 4) is not blocked by the scattering cover 32, and scatters toward the suction chamber 28. As illustrated in FIG. 4 and FIG. 5, in the intake-gas bypass system 60 in the present embodiment, seepages of the scattering liquid into the intake-gas bypass flow path 61 are inhibited by the first blocking section 76 provided to cover the secondary-side opening section 65*a* of the intake-gas bypass flow path 61 in a separated state. As a result, a liquid never accumulates at the first check valve 62 in the intake-gas bypass flow path 61. Accordingly, occurrences of reverse-flow inhibition failure of the first check valve 62 caused by the responsiveness deterioration due to a liquid can be prevented.

In addition, in the oil-recovery system 80 of the present embodiment, similar to the intake-gas bypass system 60, as illustrated in FIG. 4 and FIG. 6, seepages of the scattering liquid into the oil-recovery flow path 82 are inhibited by the second blocking section 101 provided to cover the recovery-side opening section 88*a* of the oil-recovery flow path 82 in a separated state. As a result, a liquid never accumulates at the second check valve 83 in the oil-recovery flow path 82. Accordingly, occurrences of reverse-flow inhibition failure of the second check valve 83 caused by the responsiveness deterioration due to a liquid can be prevented.

Third, the action observed at the time of an unloading operation of the compressor is explained. In the present embodiment, an unloading operation is regularly performed in order to recover, in the suction chamber 28 (the secondary side of the suction throttle valve 2) of the casing 6, a lubricant having leaked through the shaft sealing device 12.

Specifically, the pressure on the delivery-side of the compressed air system in the compressor body 1 illustrated in FIG. 1 is lowered, and the suction throttle valve 2 is closed completely. By keeping both the male and female rotors 4 and 5 rotating in this state, the pressure on the secondary side (the suction chamber 28 in the casing 6) of the suction throttle valve 2 becomes a negative pressure close to the vacuum pressure. On the other hand, since the recovery groove section 81 storing the lubricant having leaked through the shaft sealing device 12 communicates with the outside of the casing 6 via the gap between the shaft section 9 on the suction-side of the male rotor 4 and the casing 6 (suction-side cover 23) as illustrated in FIG. 3, the recovery groove section 81 has a pressure which is approximately the same with the air pressure of the external atmosphere of the casing 6 (typically, atmospheric pressure). Accordingly, the lubricant stored in the recovery groove section 81 is recovered in the suction chamber 28 in the casing 6 via the oil-recovery flow path 82 provided at the wall section of the casing 6 illustrated in FIG. 1 and FIG. 2, and the second check valve 83 arranged in the oil-recovery flow path 82 by a driving force produced by the differential pressure between the recovery groove section 81 and the secondary side of the suction throttle valve 2. In this manner, by regularly performing an unloading operation, a lubricant having leaked through the shaft sealing device 12 can be recovered to the secondary side of the suction throttle valve 2.

Fourth, the action at the shutdown of the compressor is explained. When the compressor gets stopped driving, the compressed gas on the delivery side of the compressor body 1 instantaneously flows back to the suction side due to a pressure difference. Furthermore, along with the reverse flow of the compressed gas, a liquid contained in the compressed gas also flows back to the suction side simultaneously.

At this time, due to the compressed air having flowed back to the suction chamber 28 in the casing 6, the valve body 47 of the suction throttle valve 2 illustrated in FIG. 4 slides along the rod 46 to the valve seat 44 located upstream, and the valve seat 44 gets shut off. That is, the suction throttle valve 2 gets automatically closed by the compressed air having flowed back. Thereby, a reverse flow of the compressed air and a liquid to the primary side of the suction throttle valve 2 at the shutdown of the compressor is prevented.

In addition, the compressed air having flowed back into the suction chamber 28 starts flowing back to the suction flow path 42 of the suction throttle valve 2 (the primary side of the suction throttle valve 2) via the intake-gas bypass flow path 61. In the present embodiment, the reverse flow is inhibited by the first check valve 62 arranged in the intake-gas bypass flow path 61. As mentioned before, a liquid having spouted out into the suction chamber 28 during a loading operation less likely accumulates in the intake-gas bypass flow path 61. Accordingly, the first check valve 62 less likely experiences the responsiveness deterioration caused by accumulation of a liquid during a loading operation, and can respond to the compressed air and a liquid that instantaneously flow back toward the suction chamber 28 at the shutdown of the compressor. That is, a reverse flow, toward the primary side of the suction throttle valve 2, of the compressed air having flowed back into the suction chamber 28 can be inhibited.

In addition, the compressed air having flowed back into the suction chamber 28 starts flowing back to the outside of the casing 6 (suction-side cover 23) via the oil-recovery flow path 82. In the present embodiment, the reverse flow is inhibited by the second check valve 83 arranged in the oil-recovery flow path 82. As mentioned before, a liquid having spouted out into the suction chamber 28 during a loading operation less likely accumulates in the oil-recovery flow path 82. Accordingly, the second check valve 83 less likely experiences the responsiveness deterioration caused by accumulation of a liquid during a loading operation, and can respond to the compressed air and a liquid that instantaneously flow back toward the suction chamber 28 at the shutdown of the compressor. That is, a reverse flow, to the outside of the casing 6, of the compressed air having flowed back into the suction chamber 28 can be inhibited.

According to the one embodiment of the present invention, the intake-gas bypass flow path 61 that establishes communication between the suction flow path 42 of the suction throttle valve 2 (the primary side of the suction throttle valve 2) and the suction chamber 28 (the secondary side of the suction throttle valve 2) in the casing 6 is provided at the wall section of the housing 41 of the suction throttle valve 2, the first check valve 62 is arranged in the intake-gas bypass flow path 61, and the first check valve 62 is allowed to be inserted and withdrawn via the second external opening section 65*b* of the intake-gas bypass flow path 61 opening to the outside of the housing 41. Accordingly, the structure of the intake-gas bypass system 60 can be made a pipeless structure without impairing advantages of external pipes. Accordingly, there is no need to be concerned about occurrence of cracks due to vibrations of the compressor. In addition, as compared with systems of external pipes, the number of parts can be reduced, and accordingly the cost can be reduced. Furthermore, the compressor body having a pipeless structure occupies a smaller space, there is less fear about possible damages when carrying the compressor, and the convenience in terms of handling also improves.

In addition, according to the present embodiment, the first blocking section 76 is provided between the secondary-side opening section 65*a* of the intake-gas bypass flow path 61, and the meshing sections of the male and female rotors 4 and 5, so as to cover the secondary-side opening section 65*a* in a separated state. Accordingly, seepages, to the intake-gas bypass flow path 61, of a liquid spouting out from the meshing sections during an operation of the compressor can be suppressed. Accordingly, since accumulation of a liquid near the first check valve 62 arranged in the intake-gas bypass flow path 61 is suppressed, reverse-flow inhibition failures of the first check valve 62 can be prevented. That is, the reliability of the first check valve 62 can be surely ensured.

Furthermore, according to the present embodiment, the linear second bypass-flow-path hole 65 in which the first check valve 62 is arranged is at least partially constituted by the large diameter section 70 having the second external opening section 65*b* and having a diameter larger than the diameter of the first check valve 62, the intermediate diameter section 71 adjacent to the large diameter section 70 and having a diameter smaller than the diameter of the large diameter section 70 and larger than the diameter of the first check valve 62, and the small diameter section 72 adjacent to the intermediate diameter section 71 and having a diameter smaller than the diameter of the first check valve 62. Accordingly, in replacement of the first check valve 62, it is easy to position the first check valve 62 in the second bypass-flow-path hole 65, and it is easy to insert and withdraw the first check valve 62 via the second external opening section 65*b*. That is, the first check valve 62 can be replaced very easily.

Additionally, according to the present embodiment, the two (plurality of) linear bypass-flow-path holes, the first bypass-flow-path hole 64 and the second bypass-flow-path hole 65, having the external opening sections 64*b* and 65*b* opening to the outside of the housing 41 of the suction throttle valve 2 constitute at least part of the intake-gas bypass flow path 61. Accordingly, the intake-gas bypass flow path 61 can be formed by boring a plurality of holes through the wall section of the housing 41. Accordingly, it is possible to further reduce the fabrication cost of the intake-gas bypass system 60.

In addition, according to the present embodiment, the oil-recovery flow path 82 establishing communication between the recovery groove section 81 (oil storage section) and the suction chamber 28 is provided in the wall section of the casing 6, the second check valve 83 is arranged in the oil-recovery flow path 82, and the second check valve 83 is allowed to be inserted and withdrawn via the sixth external opening section 88*b* of the oil-recovery flow path 82 opening to the outside of the casing 6. Accordingly, the structure of the oil-recovery system 80 can be made a pipeless structure without impairing advantages of external pipes. Accordingly, there is no need to be concerned about occurrence of cracks due to vibrations of the compressor. In addition, as compared with systems of external pipes, the number of parts can be reduced, and accordingly the cost can be reduced. Furthermore, the compressor body having a pipeless structure occupies a smaller space, there is less fear about possible damages when carrying the compressor, and the convenience in terms of handling also improves.

Furthermore, according to the present embodiment, the second blocking section 101 is provided between the recovery-side opening section 88*a* of the oil-recovery flow path 82 and the meshing sections of the male and female rotors 4 and 5, so as to cover the recovery-side opening section 88*a* in a separated state. Accordingly, seepages, into the oil-recovery flow path 82, of a liquid spouting out through the meshing sections during an operation of the compressor can be suppressed. Accordingly, since accumulation of a liquid near the second check valve 83 arranged in the oil-recovery flow path 82 is suppressed, reverse-flow inhibition failures of the second check valve 83 can be prevented. That is, the reliability of the second check valve 83 can be surely ensured.

Additionally, according to the present embodiment, the linear fourth recovery-flow-path hole 88 in which the second check valve 83 is arranged is at least partially constituted by the large diameter section 95 having the sixth external opening section 88*b* and having a diameter larger than the diameter of the second check valve 83, the intermediate diameter section 96 adjacent to the large diameter section 95 and having a diameter smaller than the diameter of the large diameter section 95 and larger than the diameter of the second check valve 83, and the small diameter section 97 adjacent to the intermediate diameter section 96 and having a diameter smaller than the diameter of the second check valve 83. Accordingly, in replacement of the second check valve 83, it is easy to position the second check valve 83 in the fourth recovery-flow-path hole 88, and it is easy to insert and withdraw the second check valve 83 via the sixth external opening section 88*b*. That is, the second check valve 83 can be replaced very easily.

In addition, according to the present embodiment, the four (plurality of) linear recovery-flow path holes, the first recovery-flow-path hole 85, the second recovery-flow-path hole 86, the third recovery-flow-path hole 87 and the fourth recovery-flow-path hole 88, having the external opening sections 85*b*, 86*a*, 87*a* and 88*b* opening to the outside of the casing 6 constitute at least part of the oil-recovery flow path 82. Accordingly, the oil-recovery flow path 82 can be formed by boring a plurality of holes through the wall section of the casing 6. Accordingly, it is possible to further reduce the fabrication cost of the oil-recovery system 80.

Furthermore, according to the present embodiment, the second check valve 83 is arranged at a position higher than the male rotor 4 and closer to the recovery-side opening section 88*a* than to the storage-side opening section 85*a* in the oil-recovery flow path 82. Accordingly, even if a lubricant having leaked through the shaft sealing device 12 overflows from the recovery groove section 81, the second check valve 83 is never affected by the lubricant having leaked through the shaft sealing device 12. Accordingly, the reliability of the second check valve 83 can be ensured.

Other Embodiments

Note that although in the one embodiment mentioned above, an example in which the present invention is applied to a pair of male and female screw rotors is illustrated, the present invention can also be applied to a single-rotor or triple-rotor screw compressor.

In addition, the present invention is not limited to the present embodiment, and includes various variants. The embodiment described above is explained in detail in order to explain the present invention in an easy-to-understand manner, and embodiments are not necessarily limited to the one including all the configurations that are explained. For example, some of the configurations of an embodiment can be replaced with configurations of another embodiment, and configurations of an embodiment can be added to the configurations of another embodiment. In addition, some of the configurations of each embodiment can be subjected to addition, deletion or replacement of other configurations.

For example, in the one embodiment mentioned above, an example of the configuration in which the retaining rings 74 and 99 are used for attaching the first check valve 62 and the second check valve 83 is illustrated. In another possible configuration, toothed lock washers are used instead of the retaining rings 74 and 99. In addition, in another possible configuration, by threading outer circumference sections of the first check valve 62 and the second check valve 83, and threading the inner circumferential surfaces of the flow-path holes 65 and 88 on which the first check valve 62 and the second check valve 83 are arranged, the first check valve and the second check valve are attached removably.

In addition, in the one embodiment mentioned above, an example in which the intake-gas bypass flow path 61 includes two flow-path holes, which are the first bypass-flow-path hole 64 and the second bypass-flow-path hole 65, is illustrated. The intake-gas bypass flow path 61 can also include three or more flow-path holes depending on the shape of the wall section of the housing 41 of the suction throttle valve 2. Similarly, an example in which the oil-recovery flow path 82 includes the four flow-path holes, which are the first recovery-flow-path hole 85, the second recovery-flow-path hole 86, the third recovery-flow-path hole 87 and the fourth recovery-flow-path hole 88, is illustrated. The oil-recovery flow path 82 can also include any number of a plurality of flow-path holes depending on the shape of the wall section of the casing 6.

In addition, in the one embodiment mentioned above, an example in which the first check valve 62 is arranged in the second bypass-flow-path hole 65 of the intake-gas bypass flow path 61 is illustrated. The arrangement position of the first check valve 62 can be any position in an area in the intake-gas bypass flow path 61 where accumulation of a liquid spouting out through the meshing sections of the male and female rotors 4 and 5 does not occur during an operation of the compressor. Similarly, an example in which the second check valve 83 is arranged in the fourth recovery-flow-path hole 88 of the oil-recovery flow path 82 is illustrated. The arrangement position of the second check valve 83 can be any position in an area in the oil-recovery flow path 82 where accumulation of the liquid spouting out through the meshing sections of the male and female rotors 4 and 5 does not occur during an operation of the compressor, and the second check valve 83 is not affected by a lubricant having leaked through the shaft sealing device 12.

In addition, in the one embodiment mentioned above, an example of the configuration in which the first blocking section 76 is provided in the suction chamber 28 is illustrated. The first blocking section 76 can be omitted in a case where the intake-gas bypass flow path 61 can be built in the housing 41 at a position where seepages of a liquid spouting out to the suction chamber 28 during an operation of the compressor are less likely. Similarly, an example of the configuration in which the second blocking section 101 is provided in the suction chamber 28 is illustrated. The second blocking section 101 can be omitted in a case where the oil-recovery flow path 82 can be built in the casing 6 at a position where seepages of a liquid spouting out to the suction chamber 28 are less likely.

DESCRIPTION OF REFERENCE CHARACTERS

2: Suction throttle valve
4: Male rotor (screw rotor)
5: Female rotor (screw rotor)
6: Casing
9: Shaft section
10: Suction-side bearing (bearing)
12: Shaft sealing device
16: Suction-side bearing (bearing)
27: Suction port
28: Suction chamber
41: Housing
42: Suction flow path
60: Intake-gas bypass system
61: Intake-gas bypass flow path
62: First check valve
64: First bypass-flow-path hole (bypass-flow-path hole)
**64*a***: Primary-side opening section (first opening section)
**64*b***: First external opening section (external opening section)
65: Second bypass-flow-path hole (bypass-flow-path hole)
**65*a***: Secondary-side opening section (second opening section)
**65*b***: Second external opening section (third opening section, external opening section)
70: Large diameter section
71: Intermediate diameter section
72: Small diameter section
76: First blocking section (blocking section)
80: Oil-recovery system
81: Recovery groove section (oil storage section)
82: Oil-recovery flow path
83: Second check valve (check valve)
85: First recovery-flow-path hole (recovery-flow-path hole)
**85*a***: Storage-side opening section (fourth opening section, first opening section)
**85*b***: Third external opening section (external opening section)
86: Second recovery-flow-path hole (recovery-flow-path hole)
**86*a***: Fourth external opening section (external opening section)
87: Third recovery-flow-path hole (recovery-flow-path hole)
**87*a***: Fifth external opening section (external opening section)
88: Fourth recovery-flow-path hole (recovery-flow-path hole)
**88*a***: Recovery-side opening section (fifth opening section, second opening section)
**88*b***: Sixth external opening section (sixth opening section, third opening section, external opening section)
95: Large diameter section
96: Intermediate diameter section
97: Small diameter section
101: Second blocking section (blocking section)

The invention claimed is:

1. A liquid-injected screw compressor comprising:

a screw rotor for compressing a gas;

a bearing that rotatably supports the screw rotor;

a casing that houses the screw rotor and the bearing, the casing having a suction port for suctioning a gas and a suction chamber connected to the suction port;

a suction throttle valve installed at the suction port, the suction throttle valve having a housing that forms a suction flow path communicating with the suction port; and an intake-gas bypass system that establishes communication between a primary side and a secondary side of the suction throttle valve, wherein the intake-gas bypass system includes an intake-gas bypass flow path provided in a wall section of the housing, the intake-gas bypass flow path having a first opening section that opens into the primary side of the suction throttle valve and a second opening section that opens into the secondary side of the suction throttle valve, and a first check valve arranged in the intake-gas bypass flow path, the first check valve being configured to allow a flow from the primary side to the secondary side of the suction throttle valve and to inhibit a flow from the secondary side to the primary side of the suction throttle valve, and wherein the intake-gas bypass flow path has a third opening section that opens to an outside of the housing and that allows insertion and withdrawal of the first check valve.

2. The liquid-injected screw compressor according to claim 1, further comprising a blocker provided between the second opening section of the intake-gas bypass flow path and the screw rotor so as to cover the second opening section in a separated state.

3. The liquid-injected screw compressor according to claim 1, wherein the intake-gas bypass flow path includes a linear bypass-flow-path hole in which the first check valve is arranged and which has the third opening section, and the bypass-flow-path hole includes a large diameter section having the third opening section, the large diameter section having a diameter larger than a diameter of the first check valve, an intermediate diameter section adjacent to the large diameter section, the intermediate diameter section having a diameter smaller than the diameter of the large diameter section and larger than the diameter of the first check valve, and a small diameter section adjacent to the intermediate diameter section, the small diameter section having a diameter smaller than the diameter of the first check valve.

4. The liquid-injected screw compressor according to claim 1, wherein the intake-gas bypass flow path includes a plurality of linearly extending bypass-flow-path holes, and the plurality of bypass-flow-path holes each have an external opening section that opens to an outside of the housing.

5. The liquid-injected screw compressor according to claim 1, further comprising:

a shaft sealer that seals a gap between a shaft section of the screw rotor and the casing; and an oil-recovery system that recovers, into the suction chamber, a lubricant having leaked through the shaft sealer, wherein the oil-recovery system includes:

an oil storage section provided in the casing, the oil storage section being configured to temporarily store the lubricant having leaked through the shaft sealer;

an oil-recovery flow path provided in the wall section of the casing, the oil-recovery flow path having a fourth opening section that opens into the oil storage section and a fifth opening section that opens into the suction chamber, and a second check valve arranged in the oil-recovery flow path, the second check valve being configured to allow a flow from a side where the oil storage section is located to a side where the suction chamber is located and to inhibit a flow from the side where the suction chamber is located to the side where the oil storage section is located, and the oil-recovery flow path has a sixth opening section that opens to an outside of the casing, the sixth opening being configured to allow insertion and withdrawal of the second check valve.

6. A liquid-injected screw compressor comprising:

a screw rotor for compressing a gas;

a bearing that rotatably supports the screw rotor, and is supplied with a lubricant;

a casing that houses the screw rotor and the bearing, the casing having a suction port for suctioning a gas and a suction chamber connected to the suction port;

a shaft sealer that seals a gap between a shaft section of the screw rotor and the casing; and an oil-recovery system that recovers, into the suction chamber, a lubricant having leaked through the shaft sealer, wherein the oil-recovery system includes:

an oil storage section provided in the casing, the oil storage section being configured to temporarily store the lubricant having leaked through the shaft sealer;

an oil-recovery flow path provided in a wall section of the casing, the oil-recovery flow path having a first opening section that opens into the oil storage section and a second opening section that opens into the suction chamber; and a check valve arranged in the oil-recovery flow path, the check valve being configured to allow a flow from a side where the oil storage section is located to a side where the suction chamber is located and to inhibit a flow from the side where the suction chamber is located to the side where the oil storage section is located, and the oil-recovery flow path has a third opening section that opens to an outside of the casing, the third opening being configured to allow insertion and withdrawal of the check valve.

7. The liquid-injected screw compressor according to claim 6, further comprising a blocker provided between the second opening section of the oil-recovery flow path and the screw rotor so as to cover the second opening section in a separated state.

8. The liquid-injected screw compressor according to claim 6, wherein the check valve is arranged at a position which is higher than the screw rotor, and is closer to the second opening section than to the first opening section in the oil-recovery flow path.

9. The liquid-injected screw compressor according to claim 6, wherein the oil-recovery flow path includes a linear recovery-flow-path hole in which the check valve is arranged and which has the third opening section, and the recovery-flow-path hole includes a large diameter section having the third opening section, the large diameter section having a diameter larger than a diameter of the check valve, an intermediate diameter section adjacent to the large diameter section, the intermediate diameter section having a diameter smaller than the diameter of the large diameter section and larger than the diameter of the check valve, and a small diameter section adjacent to the intermediate diameter section, the small diameter section having a diameter smaller than the diameter of the check valve.

10. The liquid-injected screw compressor according to claim 6, wherein the oil-recovery flow path includes a plurality of linearly extending recovery-flow-path holes, and the plurality of recovery-flow-path holes each have an external opening section that opens to the outside of the casing.

* * * * *